United States Patent [19]

Everett et al.

[11] Patent Number: 4,708,121

[45] Date of Patent: Nov. 24, 1987

[54] ENGINE ANALYSERS

[75] Inventors: Geoffrey J. Everett, Berkshire; Christopher J. Hunt, Somerset, both of England

[73] Assignee: FKI Crypton Limited, Sumerset, England

[21] Appl. No.: 837,351

[22] Filed: Mar. 7, 1986

[30] Foreign Application Priority Data

Mar. 7, 1985 [GB] United Kingdom ..... 8505874

[51] Int. Cl.[4] ..... F02P 1/08

[52] U.S. Cl. ..... 123/643; 324/379

[58] Field of Search ..... 123/198 DC, 643, 644, 123/650; 324/379, 388, 391, 402

[56] References Cited

U.S. PATENT DOCUMENTS

| | | | |
|---|---|---|---|
| 3,621,826 | 11/1971 | Chrestensen | 123/643 |
| 3,896,780 | 7/1975 | Kondo | 123/643 |
| 4,396,888 | 8/1983 | Everett et al. | 324/379 |
| 4,446,842 | 5/1984 | Iwasaki | 123/643 |
| 4,497,306 | 2/1985 | Hamai et al. | 123/643 X |
| 4,596,227 | 6/1986 | Hashizume | 123/643 |

*Primary Examiner*—Willis R. Wolfe, Jr.

*Attorney, Agent, or Firm*—Solon B. Kemon

[57] ABSTRACT

A method or apparatus whereby the primary windings of a multi-coil ignition system may be connected to a common terminal to provide a composite signal identifying the start of each cylinder ignition sequence. Means may also be provided for inhibiting the generation of ignition pulses by selected coils.

12 Claims, 5 Drawing Figures

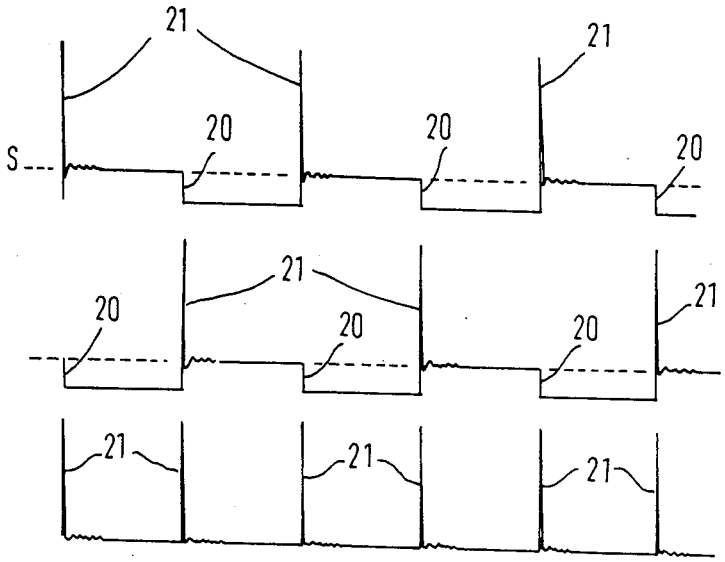
FIG. 2 A.
FIG. 2 B.
FIG. 2 C.
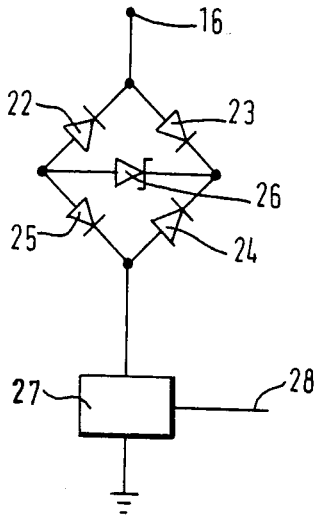
FIG. 3.

ENGINE ANALYSERS

The present invention relates to engine analysers and in particular engine analysers for multi-coil ignition systems.

BACKGROUND OF THE INVENTION

In conventional distributor type ignition systems which utilise a single ignition coil, and engine analyser may be provided with a signal comprising a series of pules each identifying the start of each cylinder ignition sequence, by connecting the analyser to the low tension side of the coil, between the coil and contact breaker. With multi-coil ignition systems a separate coil is provided for each spark plug or pair of spark plugs. Each coil is connected between a power supply and switching means by which it may be selectively connected to earth. There is consequently no common point in the ignition system at which a signal identifying the start of each cylinder ignition sequence can be obtained.

SUMMARY OF THE INVENTION

According to one aspect of the present invention a method of obtaining a composite signal identifying the start of each cylinder ignition sequence from a multi-coil ignition system having a plurality of coils, the primary windings of each coil being connected via a first terminal to a voltage supply and via a second terminal, through switch means, to earth; comprises connecting the second terminal of each coil to a common terminal through means which will prevent connection of the second terminal to the second terminals of all the other coils.

This method will provide a composite signal analogous to the signal produced between the ignition coil primary winding and contact breaker of a conventional distributor ignition system and may be used by a conventional analyser to trigger waveform display, allow cylinder power balance tests, allow individual cylinder measurements and engine ignition stop function to allow cranking tests.

According to a further aspect of the invention an apparatus for providing a composite signal identifying the starting of each cylinder ignition sequence from a multi-coil ignition system having a plurality of coils, the primary windings of each coil being connected via a first terminal to a voltage supply and via a second terminal, through switch means, to earth; comprises a plurality of leads, a separate lead for each coil, each of said leads being adapted to be connected at one end to the second terminal of a different one of said coils and at the other end to a common terminal, means being incorporated in each lead to permit the passage of a signal from the second terminal of the coil to which it is connected to the common terminal, while isolating the second terminal from the second terminals of all the other coils.

This apparatus may form part of the ignition system, the common terminal being provided for connecting the system up to an analyser or may be incorporated into the analyser.

BRIEF DESCRIPTION OF THE DRAWINGS

An embodiment of the invention is now described, by way of example only, with reference to the accompanying drawings in which:

FIG. 2A, 2B and 2C illustrate the signals present at the points A, B and C respectively in the circuit illustrated in FIG. 1, during cycling of the engine; and FIG. 3 illustrated additional circuitry which may be used to inhibit the firing of one or more cylinders during testing.

DESCRIPTION OF A PREFERRED EMBODIMENT

Figure 1:
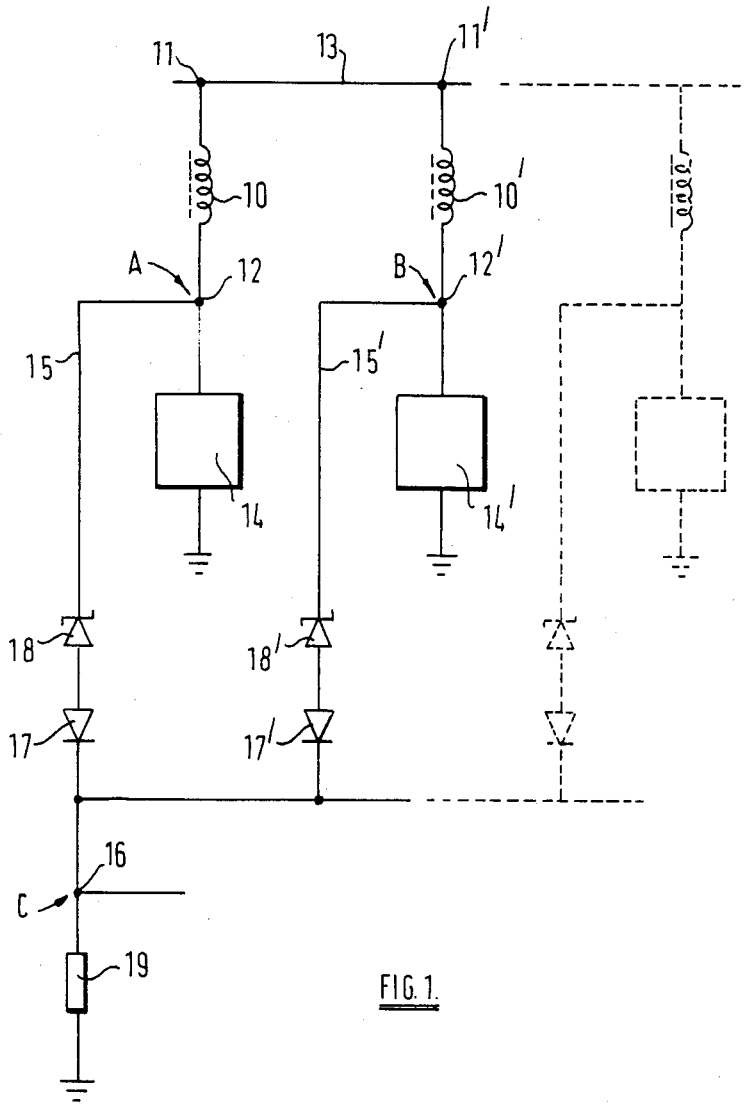
FIG. 1 is a diagrammatic illustration of a multi-coil ignition system adapted to provide a composite signal in accordance with the present invention.

The multi-coil ignition system illustrated in FIG. 1 comprises a plurality of coils 10, 10'. Only the primary windings of the coils 10, 10' have been shown, the secondary windings may either be connected between earth and a spark plug or between a pair of spark plugs. The primary windings of the coils 10, 10' are connected via terminals 11, 11' to a voltage supply line 13 which is connected to a power source (not shown). The other ends of the primary windings are connected via terminals 12, 12' to earth through switch means 14, 14'. The switch means 14, 14' may be electronic or mechanical switches driven by engine rotation and serve to complete the circuit through their associated coils 10, 10' to energise the primary windings. The current induced in the secondary winding, when the supply voltage (say 12 volts) passes through the primary winding is not sufficient to create a spark at the spark plug connected to the secondary winding. However upon opening of the switch means 14, 14' a back EMF of several hundred volts is induced in the primary winding and this produces an ignition pulse in the secondary winding sufficient to fire the spark plug. When a single spark plug is connected to the secondary winding the switch means 14, 14' will be required to operate only on the ignition stroke of the cylinder. However when a pair of spark plugs are connected to the secondary winding, both plugs are fired simultaneously, the ignition pulses being of opposite polarity, and will be fired on both the ignition and exhaust stroke of the cylinders.

The terminals 12, 12' of each coil 10, 10' are connected by lines 15, 15' to a common terminal 16. Each line 15, 15' includes a diode 17, 17' which is rated at greater than the maximum voltage appearing at terminals 12, 12', so that each terminal 12, 12' is isolated from the terminals of 12', 12 of all the other coils 10, 10'.

Each line 15, 15' also includes a zener diode 18, 18' which is rated just above the supply voltage. The common terminal 16 is connected to earth via loading resistor 19.

As illustrated in FIGS. 2A and 2B, when the switch means 14, 14' is open, terminal 12, 12' is at approximately the supply voltage S. Upon closing of switch means 14, 14' the potential at terminal 12, 12' drops to approximately zero volts (point 20). When the switch means 14, 14' reopens, a voltage pulse 21 of several hundred volts is induced in the primary winding and appears at terminal 12, 12'. This voltage pulse 21 signals the beginning of the ignition sequence of the cylinder.

The zener diodes 18, 18' do not permit the passage of the supply voltage S to the common terminal 16, but permits passage of the pulse 21, so that the composite signal generated at terminal 16 comprises a series of pulses 21 identifying the start of the ignition sequence of each cylinder, as illustrated in FIG. 2C.

A conventional engine analyser, for example as described in British Pat. No. 1,166,233, may be connected to terminal 16 and the composite signal FIG. 2C produced at that terminal may be used to drive the analyser clock which is used to trigger the wave form display, allow cylinder power balance tests, allow individual cylinder measurements and engine ignition stop function to allow cranking tests in, for example, the manner described in British Pat. No. 1,166,233.

In order to carry out cylinder power balance tests or allow engine ignition stop function, the spark ignition pulse to one or more cylinders has to be selectively inhibited. FIG. 3 illustrates a circuit which will enable the spark ignition to be inhibited while still maintaining a corresponding pulse in the composite signal which is required to maintain the analyser clock in synchronisation.

This circuit comprises a diode bridge 22, 23, 24, 25 which is connected between terminal 16 and earth via switching means 27. A zener diode 26 rated at greater than the coil supply voltage is connected across the diode bridge to provide a voltage clamp. When switching means 27 is closed, the diode bridge 22, 23, 24 25 and zener diode 26 prevent the composite signal generated at terminal 16 rising substantially above the supply voltage. The diodes 17, 18; 17', 18' in FIG. 1 then prevent the signal at terminals 12, 12' rising substantially above twice the supply voltage, which in turn prevents an effective spark generating voltage being induced in the secondary windings of coils 10, 10'. By closing switching means 27 at an appropriate time it is possible to inhibit the spark voltage for one particular cylinder only. A control signal for switching means 27 may be generated, as required, by the engine analyser and delivered to the switch along line 28. The diodes 22, 23, 24, 25 and zener diode 26, although inhibiting spark generation will still allow a signal identifying the start of each cylinder ignition sequence to be generated and passed to the analyser.

Various modifications may be made without departing from the invention. For example, whilst in the above embodiment zener diodes 18, 18' are used to remove the supply voltage component from the composite signal, the analyser may be adapted to handle the composite signal with the supply voltage component or means may be included between terminal 16 and the analyser to remove this component.

We claim:

1. An analyser for a multi-cylinder engine having a multi-coil ignition system, the primary windings of each coil being connected via a first terminal to a voltage supply and via a second terminal, through switch means, to earth; said analyser including a plurality of leads, a separate lead for each coil, each of said leads being adapted to be connected at one end of the second terminal of a different one of said coils and at the other end to a common terminal, means being incorporated in each lead to permit the passage of a signal from the second terminal of the coil to which it is connected to the common terminal to provide a composite signal identifying the start of each cylinder ignition sequence, while isolating the second terminal from the second terminals of all the other coils and means being provided for removing the supply voltage component of the signal from each coil.

2. A multi-coil ignition system having a plurality of coils, the primary winding of each coil being connected via a first terminal to a voltage supply and via a second terminal, through switching means to earth; the second terminal of each coil being connected by a separate lead to a common terminal, means being incorporated in each lead to permit the passage of a signal from the second terminal of the coil to which it is connected, while isolating the second terminal from the second terminals of all the other coils and means provided for removing the supply voltage component of the signal from each coil.

3. An apparatus for providing a composite signal identifying the start of each cylinder ignition sequence from a multi-coil ignition system having a plurality of coils, the primary windings of each coil being connected via a first terminal to a voltage supply and via a second terminal, through switch means, to earth; said apparatus comprising a plurality of leads, a separate lead for each coil, each of said leads being adapted to be connected at one end to the second terminal of a different one of said coils and at the other end to a common terminal, means being incorporated in each lead to permit the passage of a signal from the second terminal of the coil to which it is connected to the common terminal, while isolating the second terminal from the second terminals of all of the other coils and means being provided for removing the supply voltage component of the signal from each coil.

4. An apparatus according to claim 3 in which each lead incorporates a diode to isolate the second terminal to which the lead is connected from the second terminals of all the other coils.

5. An apparatus according to claim 3 in which means is provided for removing the supply voltage component from the composite signal.

6. An apparatus according to claim 3 in which a zener diode is provided in each lead to permit only the passage of signals in excess of the supply voltage, from each second terminal to the common terminal.

7. An apparatus according to claim 3 in which the common terminal is connected to earth via a load resistor.

8. An apparatus according to claim 3 in which the common terminal is connected to earth via switching means which may be triggered to prevent the composite signal generated at the common terminal rising substantially above a pre-determined voltage, whereby the generation of ignition pulses by the coils may be inhibited.

9. An apparatus according to claim 8 in which means is provided to trigger said switching means at a time corresponding to a signal at the second terminal of one of said coils, to inhibit the generation of an ignition pulse at the coil.

10. An apparatus according to claim 8 in which said switching means includes an electronic switch which is controlled by a signal corresponding to the ignition signal generated at a selected one of the coils.

11. An apparatus according to claim 8 in which said switching means includes a diode bridge which is voltage clamped by means of a zener diode.

12. An apparatus according to claim 11 in which the zener diode conducts at voltages in excess of the supply voltage, so as to prevent the composite signal generated at the terminal rising substantially above the supply voltage.

* * * * *